United States Patent [19]

Focke et al.

[11] Patent Number: 4,711,065

[45] Date of Patent: Dec. 8, 1987

[54] APPARATUS FOR PRODUCING PACKS, ESPECIALLY CIGARETTE CARTONS

[75] Inventors: Heinz Focke; Horst Langer, both of Verden; Hans-Jürgen Bretthauer, Bremen, all of Fed. Rep. of Germany

[73] Assignee: Focke & Co. (GmbH), Verden, Fed. Rep. of Germany

[21] Appl. No.: 868,155

[22] Filed: May 22, 1986

Related U.S. Application Data

[63] Continuation of Ser. No. 649,024, Sep. 10, 1984, abandoned.

[30] Foreign Application Priority Data

Sep. 14, 1983 [DE] Fed. Rep. of Germany ..... 3333053

[51] Int. Cl.[4] ..... B65B 11/32

[52] U.S. Cl. ..... 53/170; 53/201; 53/234

[58] Field of Search ..... 53/64, 170, 176, 201, 53/234, 575

[56] References Cited

U.S. PATENT DOCUMENTS

| | | | |
|---|---|---|---|
| 4,085,568 | 4/1978 | Focke et al. | 53/234 |
| 4,351,142 | 9/1982 | Focke et al. | 53/575 |
| 4,509,310 | 4/1985 | Focke et al. | 53/234 X |

*Primary Examiner*—John Sipos

*Attorney, Agent, or Firm*—Sughrue, Mion, Zinn, Macpeak & Seas

[57] ABSTRACT

Starting from an apparatus according to German Offenlegungsschrift No. 3,123,496, an apparatus for wrapping relatively large articles, especially a plurality of individual packs (cigarette cartons), is simplified and improved in terms of its mode of operation, in such a way that the packs (20) formed in different ways always leave the apparatus at the same point (discharge conveyor track 40) and can be supplied to a common pack tower (41). For this purpose, there are two folding turrets (38, 39) for wrapping the pack group (22) with different blanks.

17 Claims, 13 Drawing Figures

Figure 3:
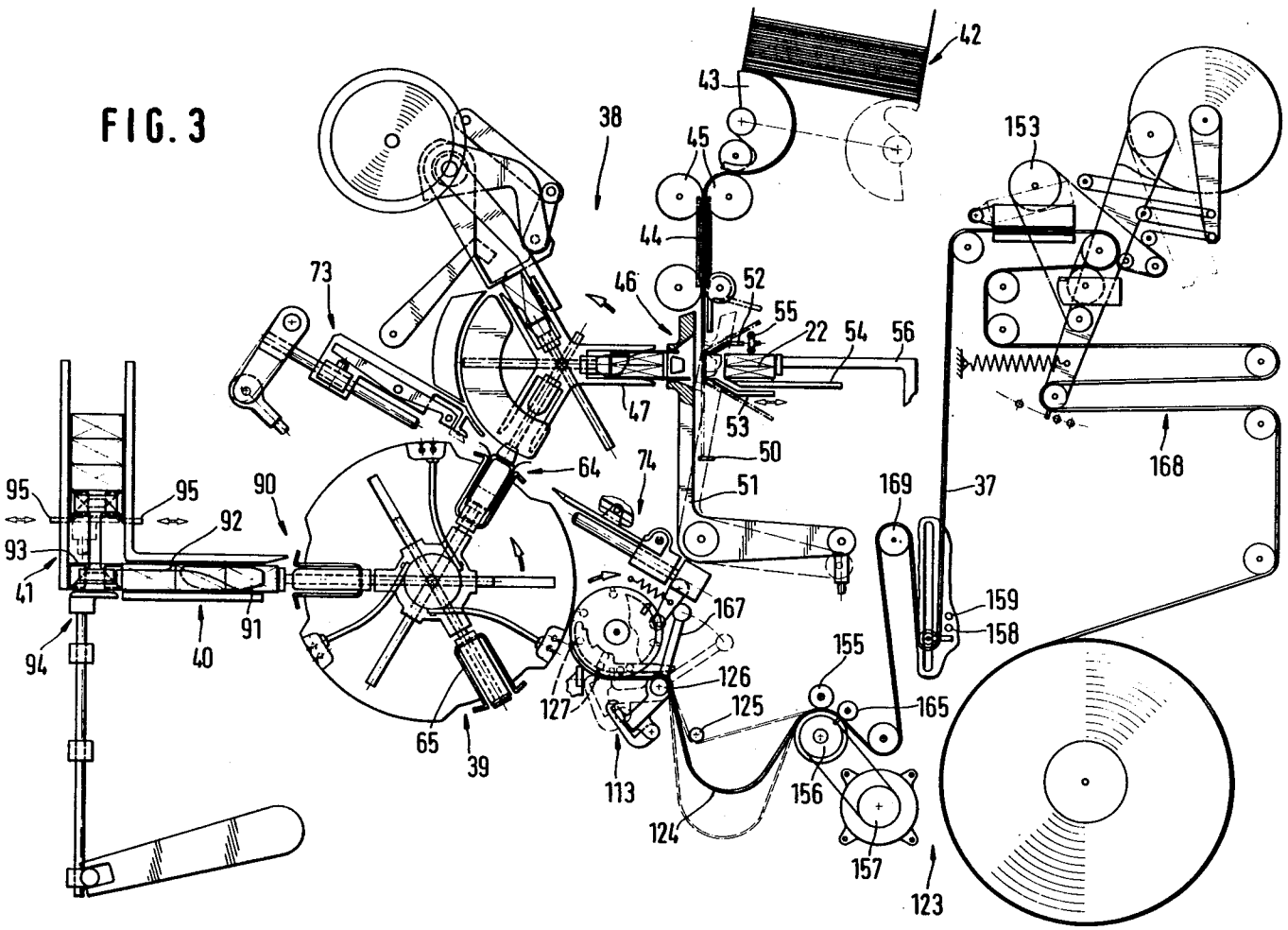

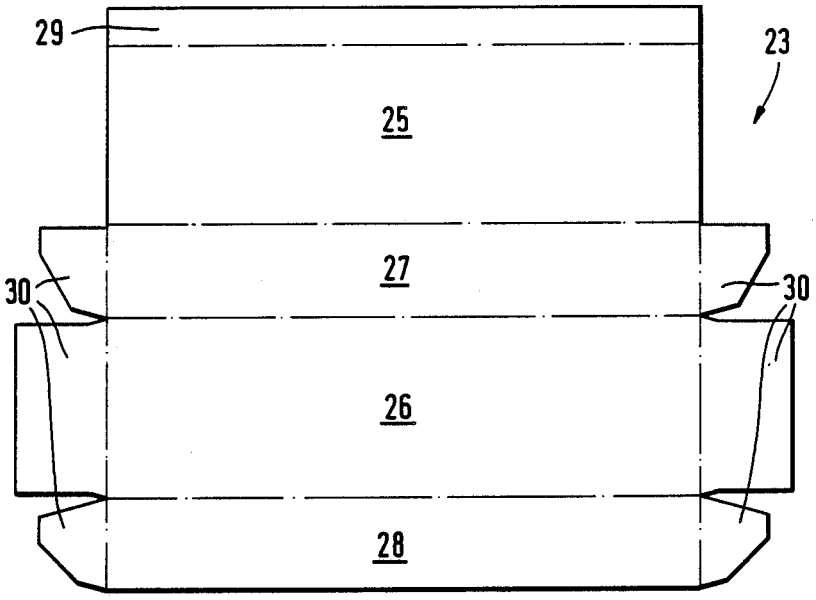
FIG. 1
FIG. 2
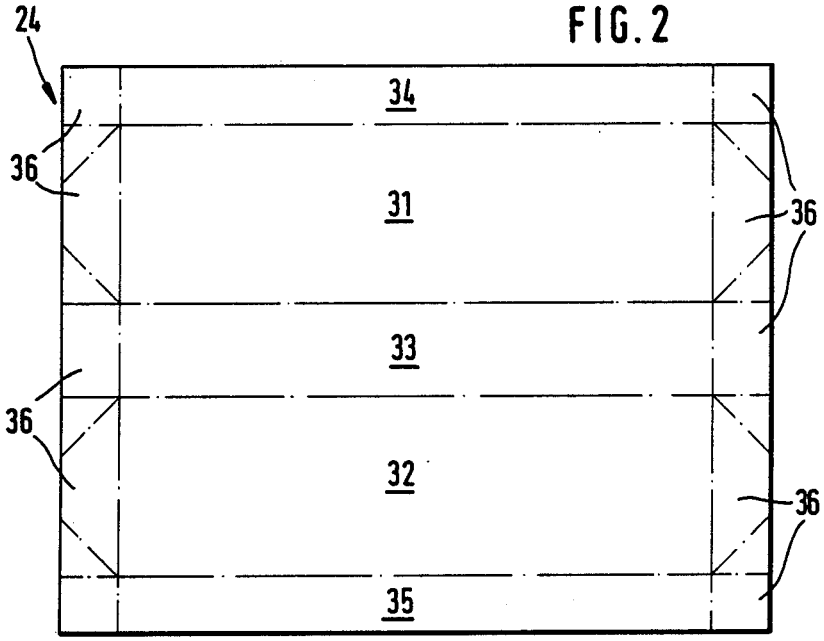

APPARATUS FOR PRODUCING PACKS, ESPECIALLY CIGARETTE CARTONS

This is a continuation of application Ser. No. 649,024 filed Sept. 10, 1984, now abandoned.

DESCRIPTION

The invention relates to an apparatus for producing packs by wrapping articles either into one blank or into several blanks, especially for producing large packs consisting of pack groups (cigarette cartons each consisting of several cigarette packs), the articles or pack groups passing in succession through wrapping and folding units so as to be wrapped in blanks (cardboard blank, paper blank, foil blank) of different types.

The production of large packs from a group of smaller individual packs is carried out, in the cigarette industry, during the production of so-called cigarette cartons. Cigarette cartons consist, for example, of ten cigarette packs which are wrapped in a common blank. This can consist of cardboard, paper or a foil. Large packs of this type can be constructed in such a way that the pack group is wrapped in several blanks.

An apparatus for producing (large) packs, especially cigarette cartons, is explained in German Offenlegungsschrift No. 3,123,496 corresponding to U.S. Pat. No. 4,509,310. In this proposal, the pack group is wrapped either in a paper blank, in a foil blank or in the two above-mentioned blanks. Depending on the construction of the pack, the pack group passes through one or two folding turrets, in the region of which blanks can be supplied and folds made. Depending on the construction, the large pack provided with one or more blanks leaves the apparatus in the region of a first upper folding turret or in the region of the second lower folding turret. The pack discharge is therefore located in two different planes.

The invention starts from an apparatus according to German Offenlegungsschrift No. 3,123,496. The object to be achieved is to make the design of the apparatus simpler and more effective, particularly in terms of a higher output. Furthermore, irrespective of the particular formation of the pack selected, the discharge of the latter from the apparatus will always be located in the same plane.

To achieve this object, the apparatus according to the invention is defined in that the articles or pack groups always pass through a (first) wrapping and folding unit for wrapping in one blank, especially a cardboard blank, and then a (second) wrapping and folding unit for wrapping in another blank, especially a paper or foil blank, and cardboard and paper or foil blanks can be supplied alternatively or cumulatively to the particular wrapping and folding unit.

Accordingly, in the apparatus according to the invention, the pack group always follows one and the same path, irrespective of which of the blanks is intended as a wrapping. The advantage of this is that the discharge of the finished packs is always located in the same plane, so that further transport can also be unified.

The apparatus according to the invention consists of two folding turrets, the first (upper) of which is intended and arranged exclusively for processing cardboard blanks. The following folding turret, through which the pack groups or the pack wrapped in the cardboard blank pass through in any case, is intended for processing paper or foil blanks. For this purpose, a sheet of material is brought up to the outer periphery of the second folding turret and retained by means of suction bores. During the transfer of the pack group or the pack from the first folding turret to the second, a paper or foil blank is provided in the region of a pocket of the folding turret and is wrapped round the pack or pack group in the form of a U when the latter is pushed into the pocket. The different possibilities for forming the packs are provided because either no cardboard blanks are supplied in the region of the first folding turret or no blanks are supplied in the region of the second folding turret.

The second folding turret for processing the foil blanks is designed in a special way. It has assigned to it a special supply device which, interacting with the folding turret, ensures that the foil blanks, which are critical in packaging terms, can be processed satisfactorily despite unfavourable dimensions (a small dimension in the conveying direction at the same time as a relatively large width).

The foil blanks are severed from the foil sheet on a cutting roller and are conveyed to the periphery of the folding turret by the cutting roller.

On the one hand the unit consisting of the folding turrets and the cutting roller and on the other hand the supply device work discontinuously or periodically, specifically in opposition to one another. During a feed movement of the folding turret and cutting roller, the supply device is stationary, whereas conversely the latter conveys a portion of the foil sheet while the folding turret and cutting roller are stationary. Between the above-mentioned units or devices, a free stock of material (sheet loop) is formed in each case, preferably in the form of a free sag which guarantees fold-free or tension-free transport of the sheet portion or the foil blank to the second folding turret.

Features of the invention relate accordingly to the design of the folding turrets, a cutting roller and supply device. Furthermore, features of the invention relate to the first folding turret and to devices for supplying and preparing the cardboard blank.

Figure 4:
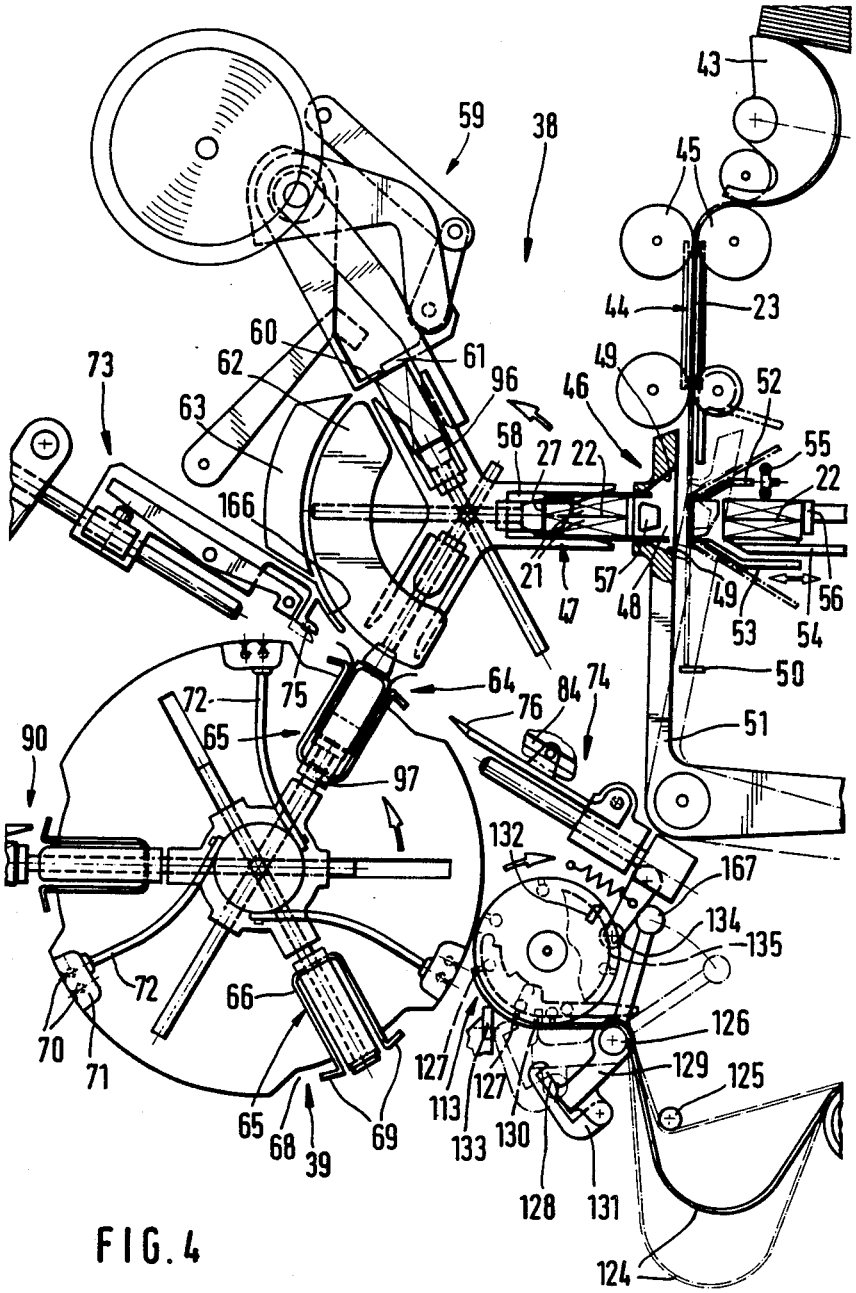
Figure 5:
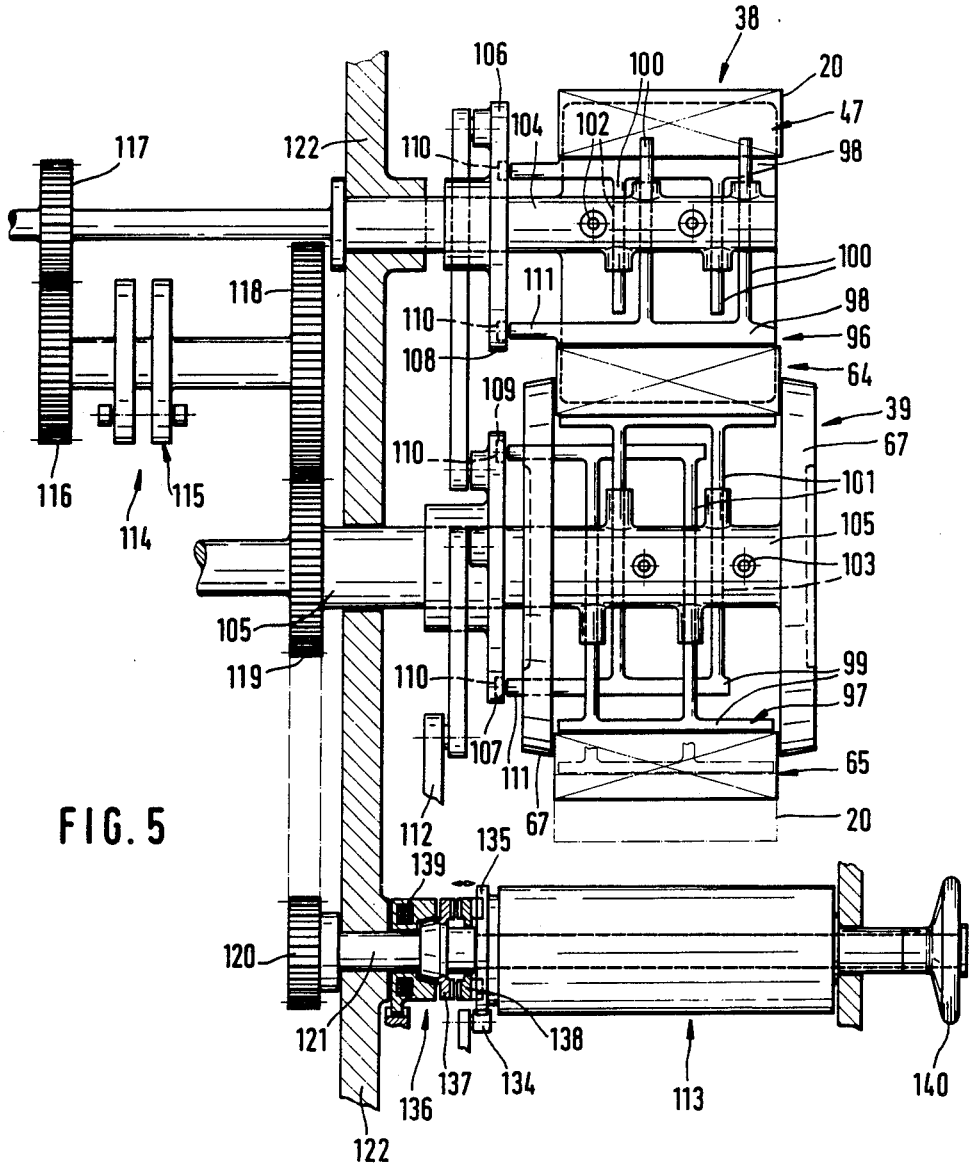
Figure 6:
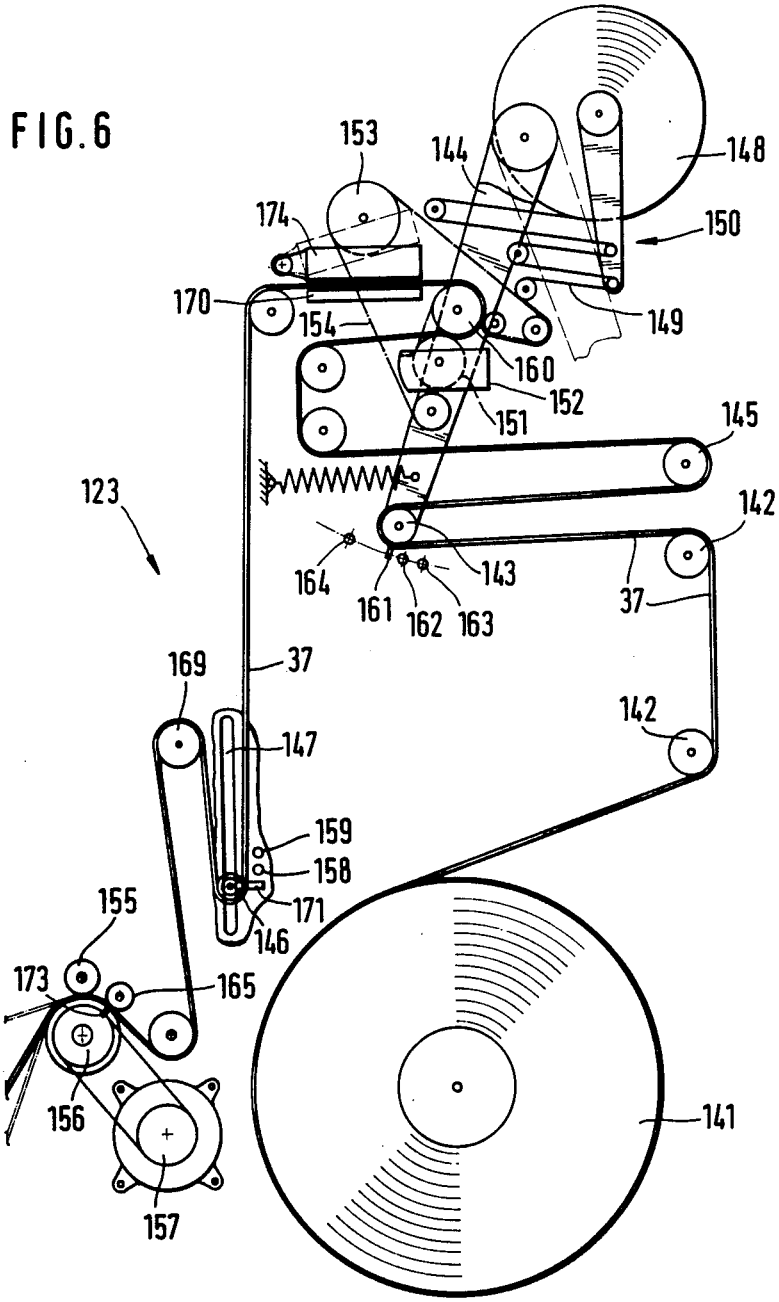
Figure 7:
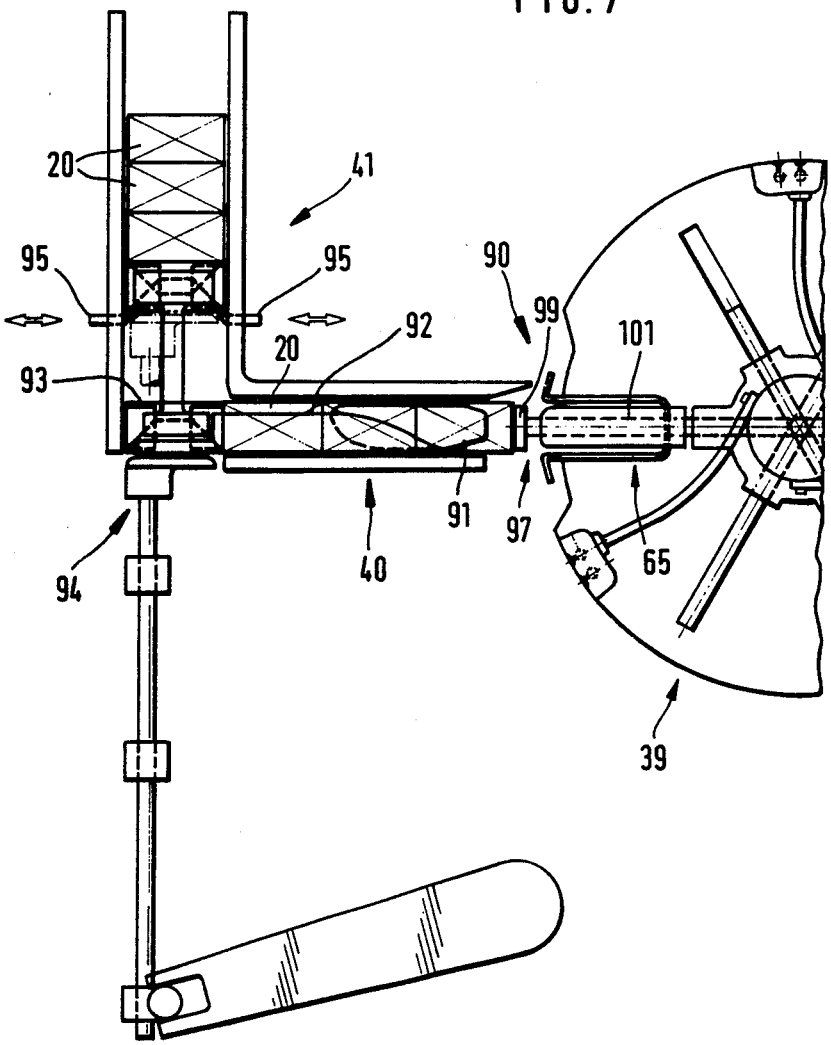
Figure 8:
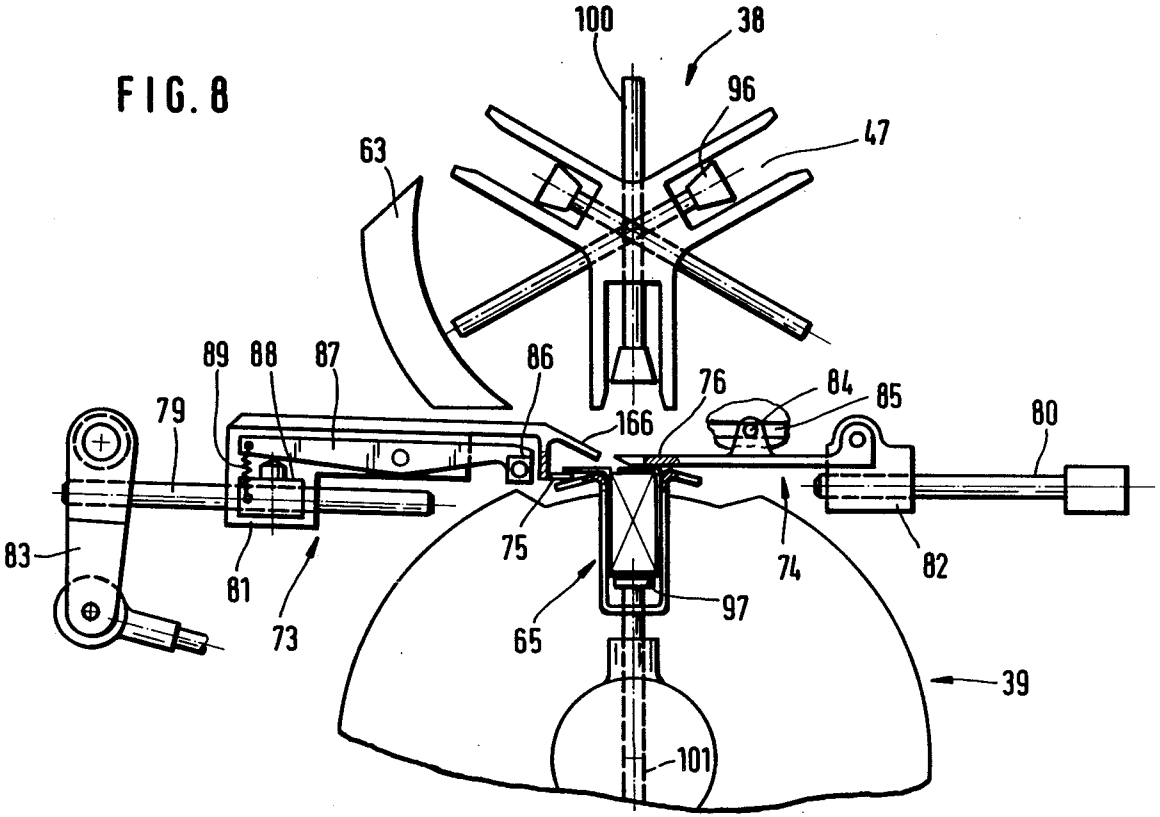
Figure 9:
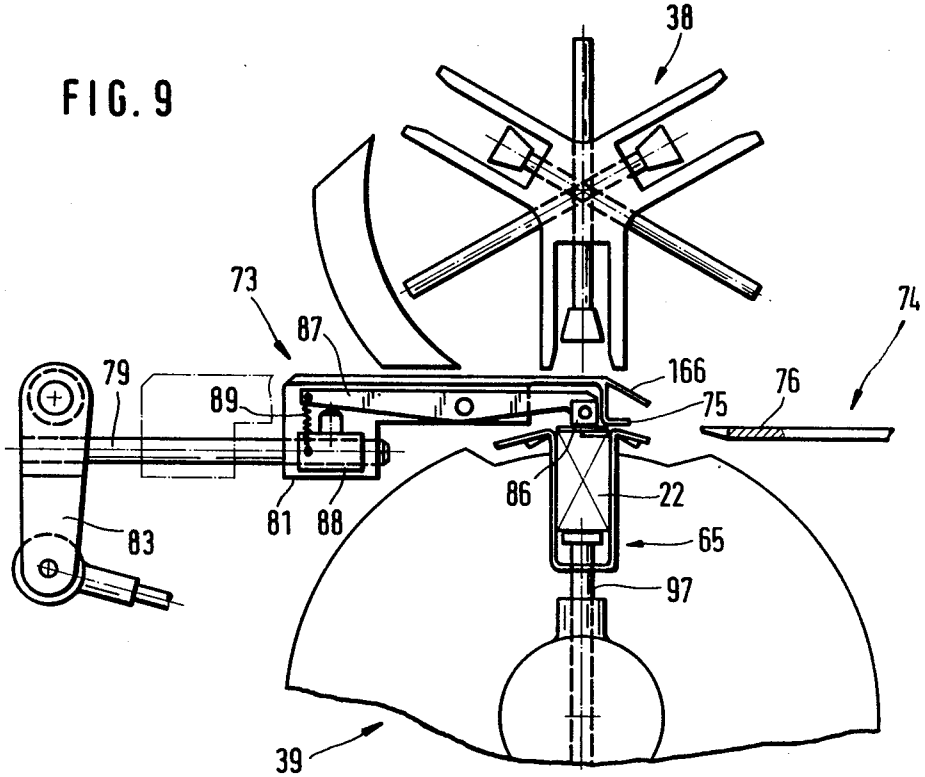
Figure 10:
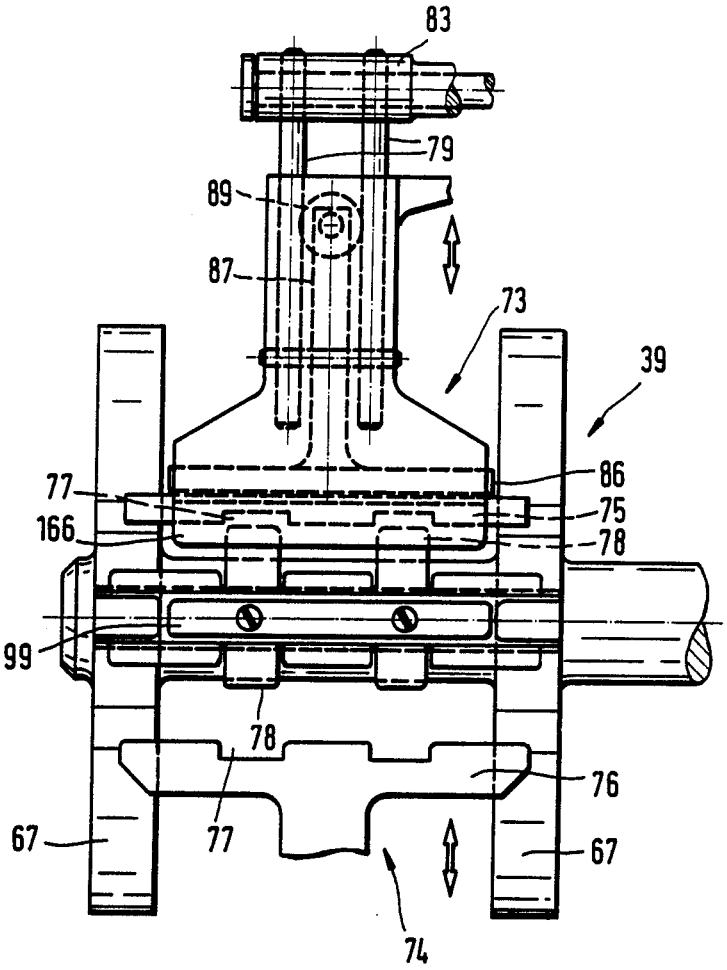
Figure 11:
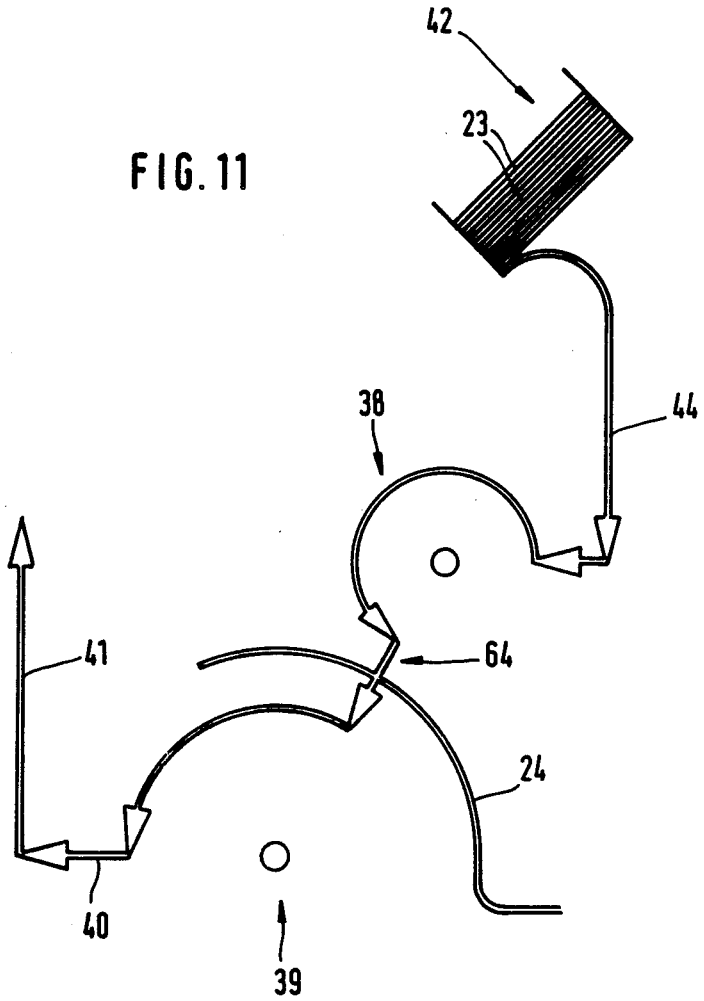
Figure 12:
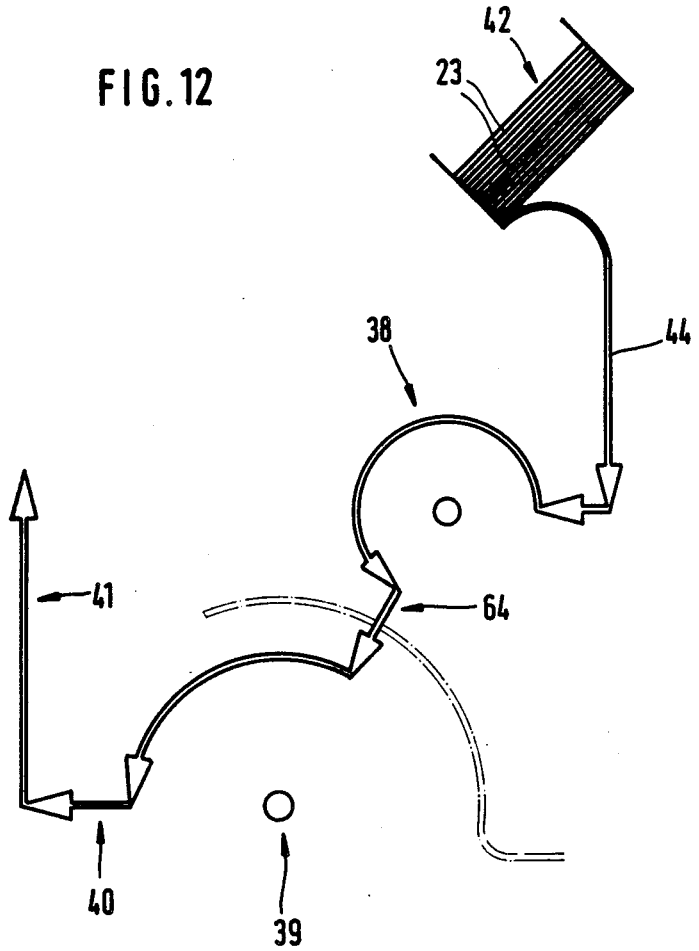
Figure 13:
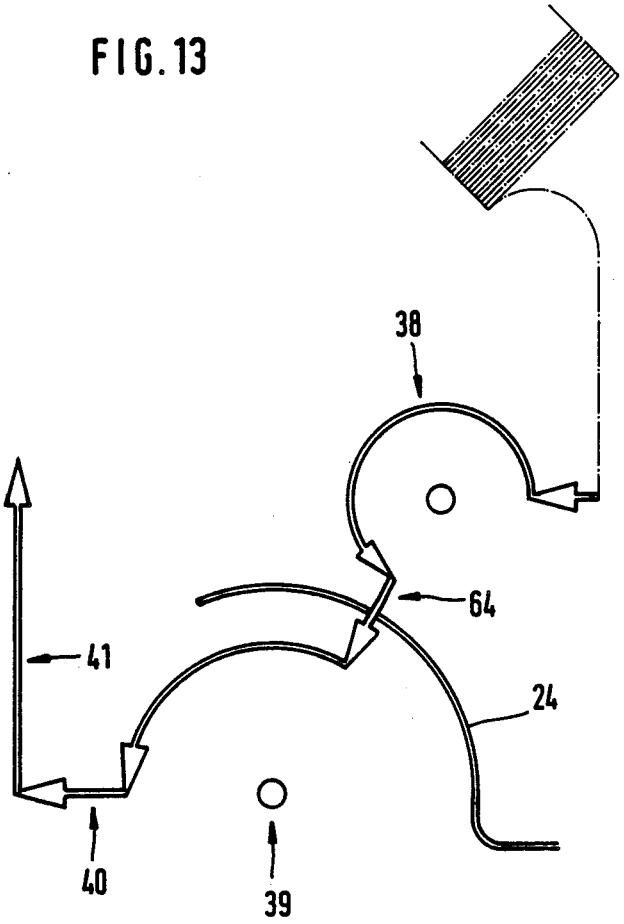

An exemplary embodiment of the invention is explained in more detail below with reference to the drawings in which, FIG. 1 shows a cardboard blank in a spread-out position, FIG. 2 shows a foil blank, likewise in a spreadout position, FIG. 3 shows the apparatus as a whole in a diagrammatic side view, FIG. 4 shows a detail of the apparatus with a first and a second folding turret, likewise in a side view, on an enlarged scale, FIG. 5 shows a vertical or radial section through the folding turrets and in the region of a cutting roller, further details being omitted, FIG. 6 part of the supply device in a diagrammatic side view, FIG. 7 shows in a side view and as a detail a pack tower for receiving the finished packs, FIG. 8 shows in a side view details, in particular folding members of the second folding turret, in a folding position FIG. 9 shows a representation according to FIG. 8, with folding members in a changed position, FIG. 10 shows the detail according to FIGS. 8 and 9, in a plan view, FIG. 11 shows a movement diagram relating to the path of a pack or pack group with a cardboard blank and foil blank through the apparatus, FIG. 12 shows a movement diagram according to FIG. 11 for a pack with a cardboard blank only, FIG. 13 shows a movement diagram similar to FIGS. 11 and 12 for a pack with a foil blank only.

The present exemplary embodiment relates above all to the production of relatively large packs 20 from several individual relatively small packs, especially. cigarette packs 21, which are combined into a pack group 22 and which leave the apparatus as cigarette cartons. The pack group 22 can be wrapped either in a cardboard blank 23 and/or in a foil blank 24 or in a paper blank (not shown).

An example of a cardboard blank 23 is shown in FIG. 1. According to this, it consists of individual surface regions to form an upper wall 25, a lower wall 26, side walls 27 and 28 and a tube tab 29. Lateral closing tabs 30 are located in the region of the lower wall 26 and side walls 27 and 28.

The foil blank according to FIG. 2 is designed in a similar way, namely likewise with an upper wall 21, a lower wall 32, a side wall 33 and two tube tabs 34 and 35 located at the edges, to form a side wall. All the above-mentioned blank parts are provided laterally with end tabs 36. In the present case, the cardboard blank 23 is prefabricated, in particular prestamped, whilst the foil blank 24 is severed from a continuous foil sheet 37. Depending on the requirements in practice, the pack group 22 is wrapped in one or in both of the blanks according to FIGS. 1 and 2.

In any case, that is to say irrespective of the number and type of blanks, the pack group 22 passes through a first folding turret 38 and then a second folding turret 39. The packs 20 are pushed out of the latter in a radial direction into an essentially horizontal discharge track 40. The latter has adjoining it, in turn, a vertical pack tower 41 into which the finished packs 20 are pushed from below.

A blank magazine 42 for receiving a stock of cardboard blanks 23 is assigned to the first folding turret 38. A particular cardboard blank 23 is extracted on the underside of the blank magazine 42 by a dispenser 43 of known design and introduced into a vertical blank track 44. By means of transport rollers 45 located in the region of this blank track 44, the cardboard blank 23 is conveyed in a vertical plane in front of a mouthpiece 46. This is located in front of the first folding turret 38, in such a way that the pack group 22 can be introduced in a horizontal plane through the mouthpiece 46 into a pocket 47 of the folding turret 38. For this purpose, the mouthpiece 46 limits a mouthpiece orifice 48, the dimensions of which correspond essentially to those of the pack group 22. The mouthpiece 46 is designed on the inlet side with converging upper and lower guide surfaces 49. These center the pack group 22 when it is pushed into the folding turret 38. When the pack group 22 is pushed into the pocket 47, the cardboard blank 23 is carried along with it and wrapped round the pack group 22 in the form of a U, the side wall 27 being located at the front in the direction of movement, whilst the remaining still unfolded parts of the blank rest as legs against the pack group 22 at the top and bottom.

Before being pushed into the folding turret 38, the cardboard blank 23 is supported on a lower stop 50. Furthermore, before being pushed in, the cardboard blank 23 is preshaped in the form of a U. For this purpose, the mouthpiece 46 can be moved, in particular pressed against the (vertical) cardboard blank 23 by a pivoting arm 51. In interaction with fixed upper and lower shaping plates 52 and 53, the U-shaped prestamping is carried out as a result of the form of the mouthpiece orifice 48. The relatively stiff cardboard blank 23 can now be pushed into the pocket 47 by and together with the pack group 22.

Before the pack group 22 is pushed in, it is located on a horizontal platform 54. The cigarette group 22 is conveyed onto this transversely to the pushing-in direction, in the present case by means of an upper rotating conveyor belt 55. A pushing-in device 56 of appropriate width causes the pack group 22 together with the cardboard blank 23 to be pushed into the pocket 47.

When the pack group 22 together with the cardboard blank 23 is pushed in, the closing tab 30 connected to the side wall 27 is consequently folded round against the end face of the pack group 22, specifically by means of a folder 57 in the region of the mouthpiece 46. The folded-round closing tab 30 is retained in the pocket 47 by lateral webs 58 at the ends of the pockets 47.

The folding turret 58 consisting of only three pockets 47 then conveys the pack group 22 together with the cardboard blank 23 into a folding station 59. In this, the projecting tabs of the cardboard blank 23 are folded, particularly also the side wall 28 in conjunction with the tube tab 29, both on the radially outer side of the pocket 47, by means of tube folders 60 and 61. The design and mode of operation of these and other folding members are known in principle.

During the further transport of the pocket 47 as a result of periodic rotation of the folding turret 38, the folded tabs of the pack or of the cardboard blank 23 are fixed in their folded position by immobile guide members. These are arcuate guide plates 62 for the tube tabs located on the end face and a radially outer arcuate supporting plate 63.

In the region of a transfer station 64, the pack 20 or pack group 22 produced thus far is ejected from the pocket of the first folding turret 38 and at the same time introducing to an adjacent pocket 65 of the second folding turret 39.

The folding turret 39 is also equipped with three pockets 65 arranged at equal peripheral distances from one another. These consist of a pocket lining 66, for example made of sheet metal, of U-shaped cross-section. On the radially outer side, the pockets 65 or pocket linings 66 project beyond the profile of the turret. A turret body consisting of lateral turret disks 67 is provided with radial recesses 68 in the region of the pockets 65. The pocket linings 66 extend within these recesses. The free edge of the former is provided with a supporting leg 69 angled in the peripheral direction. These supporting legs are arranged at an acute angle to the pocket lining, that is to say bent slightly inwards radially. The supporting legs serve for receiving blank parts, in particular the tube tabs 34 and 35 of the foil blank 24 during an intermediate position of the latter. The pocket lining 66 extends over the full width of the folding turret 39 and therefore connects the turret disks 67 to one another.

To wrap the pack 20 or a pack group 22 in a foil blank 24, the latter is laid against the outer periphery of the folding turret 39, specifically in such a way that the foil blank 24 is located approximately centrally in relation to the particular pocket 65. The foil blank 24 is grasped (only) in a region located at the front in the direction of rotation of the folding turret 39 and is fixed by means of suction air. For this purpose, the folding turret 39 is provided at suitable points with suction bores 70 on the outer periphery. In the design of the folding turret or turret body with two lateral turret disks 67, the suction bores 17 in both turret disks 67 are arranged in inserts 71 located opposite one another. Consequently, the foil blank 24 is grasped on the folding turret 39 in front lateral regions only and is thereby retained free of constraint and free of creasing. The suction bores 70 are connected in a suitable way to a central vacuum source via suction lines.

The pack group 22 or the already previously attached cardboard blank 23 is wrapped in the foil blank 24 in a way which is known in principle. When the pack group 22 is introduced into the pocket 65 in the region of a transfer station 64, the foil blank 24 provided on the outer periphery of the folding turret 39 is carried along with it, at the same time wrapping the pack group 22 in the form of a U. The tube tabs 34, 35 project from the pocket on the outer side and predominantly lie against the supporting legs 69 as a result of the technological property of the foil.

In the present exemplary embodiment, the pack tube is completed in the region of the transfer station 64, and accordingly the tubular tabs 34, 35 are folded into their position. For this purpose, the transfer station 64 has assigned to it tube folders 73 and 74 which each grasp a tube tab 34, 35 by means of (essentially) tangentially moveable folding members and which fold them into the plane of the side face, whilst at the same time overlapping one another.

To guarantee with absolute certainty that the tube tabs 34, 35, adhering where appropriate to the supporting legs 69, are carried along reliably by the tube folders 73, 74, during the tangential movement the latter execute additionally a lifting or radial movement. The supporting legs 69 on the one hand and the ends of the tube folders 73, 74 on the other hand, namely a folding leg 75 of the tube folder 73 and a folding plate 76 of the tube folder 74, are made comb-like in a matching way, with recesses 77 on the one hand and projections 78 on the other hand. As a result, from the radially inner side of the supporting legs 69, that is to say on the outside of the tubular tabs 34, 35, the folding members (folding legs 75 or folding plate 76) can grasp the latter and lift them off from the supporting legs 69 as a result of an appropriate movement directed radially. During the further tangentially directed movement of the tube folders 73, 74, the tube tabs 34, 35 are folded round (in succession). The tube folder 73 is provided with an arcuate supporting leg 166 which, in the initial position of the tube folder 73, forms an extension of the supporting plate 63 on the outer periphery of the folding turret 38.

The two tube folders 73, 74 or their folding members are displaceable in a longitudinal direction on supporting rods 79, 80 by means of sliding bodies 81, 82. The tangential movement of the folding members is essentially determined by the movement on the supporting rods 79, 80. However, as regards the tube folder 73, the supporting rod 79 is mounted pivotably on a pivoting arm 83. As a result of the pivoting movement of the latter, the folding member, namely the folding leg 75, executes the above-described radial movement to lift the tubular tab 34 off from the supporting leg 69.

The supporting rod 80 is arranged immovably. However, the folding plate 76 is mounted movably, in particular pivotably, on the sliding body 82. The pivoting movement of the folding plate 76 is controlled via a lateral guide pin 84 on the latter, namely in a radial direction to lift the tube tab 35 off from the supporting leg 69, specifically as a result of :he engagement of the guide pin 84 in a controlled cam 85.

The tube tabs 34, 35 folded over one another are welded or sealed to one another in the region of transfer station 64. For this purpose, here, the tube folder 73 for the outer tube tabs 34 is equipped with a sealing member, namely with a sealing jaw 86 directed transversely. This is arranged in such a way that, in the end position of the tube folder 74, it extends in the region of the tubular tabs 34, 35 arranged over one another.

The sealing jaw 86 is located at the end of a two-armed actuating lever 87. This is mounted pivotably on the tube folder 73 and is actuated, here, via an electromagnet 88 against the retaining force of a tension spring 89. The sealing jaw 86 is heated in a suitable way.

The pack 20 or the pack group 22 with the foil blank 24, produced thus far, is moved from the transfer station 64 into a pushing-out station 90 as a result of an appropriate rotary movement of the folding turret 39. Here, the pack 20 is ejected into the discharge track 40. During this pushing-out operation or the entry into the discharge track 40, the laterally projecting end tabs 36 are folded round in a way known per se by folding tabs 91 or folding switches 92. An upper end tab is folded round by fixed folding edge 93 during the upward movement of the pack 20 into the actual pack tower 41. The upward movement is executed by means of a pack lifter 94 which is moved up and down. The packs 20 are lifted by the latter up to the plane of lateral supporting fingers 95. These come under the lifted pack from the sides and carry it together with those located above it, when the pack lifter 94 is moved back into the lower initial position.

The folding turrets 38, 39 are designed and driven in a special way. In both cases, radially movable pushing-out devices 96 and 97 are provided in the region of the pockets 47 and 65 respectively. In the initial position drawn inwards, these pushing-out devices 96, 97 or a transverse strip 98, 99 of the latter form the radially inner bottom of the pockets 47 and 65. The transverse strip 98, 99 is attached to (two) guide rods 100 and 101 which are mounted displaceably and supported in radial guide bores 102, 103 of a turret shaft 104, 105. The controlled movement of the pushing-out devices 96, 97, especially for pushing packs or pack groups out of the associated pockets, is executed by means of control disks 106, 107 which are assigned to each folding turret 38, 39. Control rollers 110 run in cam grooves 108, 109 of these control disks 106, 107 and are connected to the pushing-out devices 96, 97 or to the transverse strips 98, 99 of the latter via an extension 111. The control disks 106, 107 are driven to rotate, specifically during the standstill phase of the folding turrets 38, 39. As a result of a rotary movement of the control disks 106, 107 and a result of an appropriate design of the cam grooves 108, 109, the pushing-out devices 96, 97 are moved in one direction or the other during the standstill of the folding turrets 38, 39. The control disks 106, 107 connected operatively to one another are actuated via a drive (link 112) not shown in detail.

The folding turrets 38, 39 and a cutting roller 113, which is yet to be described in detail, are driven synchronously and at the same peripheral speeds by means of a common gear. A stepping gear 114 of suitable known design is provided for the periodic drive. FIG. 5 illustrates a switching star 115 as an output member of this stepping gear 114. The turret shaft 104 of the folding turret 38 is driven via gear wheels 116, 117. Starting from the switching star 115, the turret shaft 105 of the folding turret 39 is driven via further gear wheels 118, 119. The gear wheel 119 is connected operatively to a gear wheel 120 for the rotary drive of the cutting roller 113. The turret shafts 104, 105 and a shaft piece 121 assigned to the cutting roller 103 are mounted rotatably in the common machine wall 122.

The supply device 123 for the foil sheet 37 is assigned to the folding turret 39 for the foil blank 24. The folding turret 39 and the cutting roller 113, the periphery of which adjoins the periphery of the above-mentioned folding turret, form a drive unit which is coordinated with the supply device 123 in terms of movement. A particular portion of the foil sheet 37, which corresponds to the length or width (in the direction of transport) of thefoil blank 24, is conveyed by the latter. During this conveyance, the folding turret 39 and the cutting roller 113 are stationary. When the supplied portion of the foil sheet 37 or the foil blank 24 severed from the latter is received and transported by the folding turret 39, the supply device 123 is in the position of rest. During the preceding supply cycle, the latter has produced a sheet stock, specifically a free sheet sag 124. This is located in the direction of transport, in front of the cutting roller 113 which at the same time serves as a direct supply member for supplying the front end of the foil sheet 37 to the folding turret 39. During the simultaneous rotary movement of the cutting roller 113 and the folding turret 39, the sheet stock, that is to say the sheet sag 124, is eliminated, until the foil sheet 37 comes up against a tautening roller 125 preceding the cutting roller 113. This tautening roller is driven in opposition to the direction of movement of the foil sheet 37 and serves for smoothing the latter. The foil sheet is guided up to the periphery of the cutting roller 113 via a fixed deflecting rod 126. Before the foil sheet 37 reaches the taut position (up against the tautening roller 125), the foil blank 24 is severed from the foil sheet 37, specifically by a severing knife 132 rotating with the cutting roller 113. This severing knife interacts with a fixed counter-knife 133.

After the foil blank 24 has been severed, transport by the cutting roller 113 and the folding turret 39 is continued, until the position, shown in FIG. 4, of the following foil sheet 37 on the cutting roller 113 is reached. The foil sheet 37 is now in the taut position and cannot be conveyed any further. The cutting roller 113 and the folding turret 39 are now stopped in a predetermined relative position. The supply device 123 now begins to transport the foil sheet 37 further, thereby forming a new sheet sag 124. The exact standstill position of the cutting roller 114 is marked by an engagement means, in the present case by an engagement roller 134 which, in the position of rest of the cutting roller 113, comes into a recess in a disk 135 connected to the cutting roller 113.

The cutting roller 113 is provided on its periphery with suction bores 127 which grasp the front end of the foil sheet 37. This is received by the folding turret 39 in the region of close proximity between the cutting roller 113 and folding turret 39, in particular by means of the suction bores 70 on the periphery of the folding turret 39.

A piercing knife 128 is assigned to the cutting roller 113. This takes effect when a new foil sheet is threaded in (manually). The front end of the foil sheet 37 is laid against the periphery of the cutting roller 113. When the piercing knife 128 is actuated, a correct front edge suitable for the further processing of the foil sheet 37 is provided. In the present case, the piercing knife 128 is attached to a pivoting arm 129 mounted on the deflecting rod 126. When the foil sheet 37 is cut through, the piercing knife 128 penetrates into a slot 130 of the cutting roller 113. The cutting movements of the piercing knife 128 are executed manually by means of a handle 167.

A tautener 131 is assigned to the piercing knife 128. This is brought, together with the piercing knife 128, up to the periphery of the cutting roller 113 and presses the foil sheet 37 against the latter. It is thereby by tensioned free of creasing during piercing by the piercing knife 128. The tautener 131 is attached to the pivoting arm 129 so as to be relatively movable with the latter.

The cutting roller 113 can be uncoupled from the common drive, particularly for adjustment purposes or for threading in the foil sheet in the event of tearing of the sheet. For this purpose, a special clutch 136 is provided. This consists of the clutch parts 137 and 138 which can be engaged positively with one another via teeth or released from one another as a result of an axial movement of the clutch part 137. The latter can be subjected to electromagnetic force by means of an electric coil 139 and is thus displaceable on the shaft piece 121. The clutch part 138 is connected fixedly in terms of notation to the disk 135. When the clutch 136 is released, the cutting roller 113 can be adjusted by means of a handwheel 140.

According to FIG. 6, the supply device 123 draws the foil sheet 37 off from a foil reel 141. The foil sheet 37 runs over several deflecting rollers 142 to a pendulum roller 143. This is attached to a pendulum arm 144 pivotable against a spring load. A sheet loop can be drawn by means of the pendulum formed in this way, in conjunction with the deflecting rollers 142 and 145.

The foil sheet 37 then leaves via further deflecting rollers to a further pendulum consisting of a dancing roller 146 which is movable up and down in a slot guide 147. A sheet stock can be formed even in this region, in conjunction with a further deflecting roller 169.

A tear-open thread 149 is drawn off from a thread reel 148 and is supplied to the foil sheet 37 or attached to it. The tear-open thread 149 runs via a double pendulum 150. The foil sheet 37 is provided with strips of glue by a glue roller 151 dipping into a glue pot, so that the tear-open thread 149 attached subsequently adheres to the foil sheet 27. The glue roller 151 is driven by a brake motor 153 via a belt drive with a toothed belt 154. The latter also drives a forward drawing roller 160. This is a member which exerts a tensile force on the foil sheet 37, but with slip.

In the region of a horizontal conveying zone of the foil sheet 37, the tear-open thread 149 is pressed by heated clamping jaws 169, 170 against the foil sheet 37, specifically during a standstill phase of the latter. The glue previously applied is activated as a result of the heating.

The foil sheet 37 is predrawn in portions by means of a pair of draw rollers 155 and 156. The draw roller 156 is driven by a main motor 157. The casing of the draw roller 156 is provided with an elastic covering. The main motor 157 is a servo-motor which guarantees exact predrawn lengths of the foil sheet 37. The predrawn length is coordinated with the size of the draw roller 156, in such a way that the conveyed length of the foil sheet 37 exactly corresponds to the periphery of this draw roller 156 at any particular time.

The foil sheet 37 is predrawn in portions by a pair of draw rollers 155 and 156. The draw roller 156 is driven by a main motor 157. The casing of the draw roller 156 is provided with an elastic covering.

During the predrawing of the foil sheet 157 by the draw rollers 155 and 156, the dancing roller 146 is moved upwards. At the same time, initiators 158 and 159 are activated in succession by an index 171. The brake motor 153 is switched on when the second, upper initiator 159 is activated. The (further) forward-drawing roller 160 driven by the brake motor is driven as a result, and the glue roller 151 is also driven at the same time. Furthermore, the predrawing of the tear-open thread 149 is set in motion.

The region of the foil sheet 137 facing the foil reel 141 now also starts to move. As a result of the further conveyance of the foil sheet 37, the dancing roller 146 moves slowly downwards. The pendulum roller 143 of the pendulum arm 144 is moved to the right (in relation to FIG. 6). An index 161 of the pendulum roller 143 thereby passes initiators 162 and 163 in succession. As a result, a known electromagnetic reel brake assigned to the foil reel 141 is released. The foil reel 141 starts to rotate. Because of the supply of the foil sheet 37, the spring-loaded pendulum arm 144 executes an opposing movement, with the result that the initiators 162 and 163 are stressed in the opposite direction. Consequently, the electromagnetic reel brake is applied to the foil reel 141 again. In the event of a tearing of the sheet, the pendulum arm 144 is pivoted to the left by means of a tension spring 172 (FIG. 6), so that a third initiator 164 is passed and the entire machine is switched off.

Located in the region of the draw roller 156 is a stamping roller 165, by means of which an appropriately formed tongue is stamped in the region of the tear-open thread by means of a U-shaped stamping knife 173. The stamping knife 173 is arranged so as to co-rotate on the draw roller 156.

Finally, as a result of the further conveyance of the foil sheet 37, the dancing roller 146 passes into the lower initial position shown by way of example in FIG. 6. When it passes the lower initiator 158, the forward-drawing roller 160 is thereby switched off again.

The apparatus thus described allows a multiplicity of pack forms to be produced, without notable changes to the apparatus itself having to be made. FIGS. 11, 12 and 13 illustrate respectively by means of double lines the path of movement of the pack group 22 or the pack 20 and the path of movement of a blank or a foil sheet which is possibly present. Accordingly, FIG. 11 shows a design in which the pack group 22 is first wrapped in a cardboard blank 23 and then in a paper or foil blank 24. In this design, both folding turrets 38, 39 are active as folding units.

The illustration in FIG. 12 shows the production of packs 20 in which the pack groups 22 are wrapped in the cardboard blank 23 only. The pack 20 complete thus far also passes through the (second) folding turret 39, but without being wrapped again here. A foil sheet 37 or a foil blank 24 is not supplied here.

FIG. 13 shows a third possibility, namely the wrapping of the pack group 22 in a foil blank 24 only. In this case, the pack group 22 initially passes through the first folding turret 38 without being wrapped. In the region of the second folding turret 39, it is then wrapped in the foil blank 24 in the way described.

Irrespective of the design of the packs 20, they are always pushed out of the folding turret 39 in the region of the pushing-station 90 and pushed into the pack tower 41 via the discharge track 40.

We claim:

1. An apparatus for selectively wrapping packs (22) in at least one of two blanks (23, 24) and for discharging said packs wrapped in only a first blank, in only a second blank, or in both said first and second blanks, comprising:

first (38) and second (39) wrapping turrets arranged one above the other with their rotational axies parallel to each other all of said packs passing through both of said first and second wrapping turrets;

each of said wrapping turrets including only three pockets (47, 65), each of said pockets being open at an end thereof to receive one pack (22);

means for synchronously rotating said first and second turrets in the same direction;

feeding means including a transfer station (64) between the two turrtes for feeding all of said packs to be wrapped either in the first, the second, or both of said blanks first through said first turrets, then through said transfer station (64) and then through said second turret, said feeding means including means for pushing a pack (22) in a pocket (47) of said first turret out of said first turret pocket and directly into a pocket (65) of said second turret;

first supply means (42) for selectively supplying said first blanks (23) to said first turret;

second supply means (123) for selectively supplying said said second blanks (24) to said second turret; and a sole discharge means (40, 41) fixedly arranged to receive only packs discharged from said second turret wrapped only in said first blank, only ;n said second blank, or in both said first and second blanks depending upon which of said supply means have supplied blanks to their respective turrets.

2. The apparatus as claimed in claim 1, wherein said first blank is a prestamped U-shaped cardboard blank having at least one lateral wall (27), and said open ends of the pockets (47) of said first turret have a mouthpiece (46) cooperating therewith, said apparatus further including means for causing said at least one pack to engage said lateral wall to push said first blank into a pocket of said first turret as said pack is pushed into said pocket.

3. The apparatus as claimed in claim 2, wherein said mouthpiece includes guide surfaces (4), said apparatus further including shaping plates (52, 53) and pivot means for moving said mouthpiece toward and away from said shaping plates so that as said mouthpiece moves toward said shaping plates with a first blank therebetween, the said first blank is preshaped into a U-shape.

4. The apparatus as claimed in claim 1, wherein of at least one turret (38, 39) said means for pushing includes a pushing-out device (96, 97) provided for each pocket of at least the first turret and movable in a radial direction to push out the packs contained in the pockets (47, 65).

5. The apparatus as claimed in claim 1, wherein the pockets (65) of said second turret (39) are U-shaped with sheet metal pocket linings (66) having in the region of their radial outer edges angled supporting legs (69) pointing in the peripheral direction for the temporary support of portions of the blanks contained therein.

6. The apparatus as claimed in claim 5, wherein said second turret (39) includes two turret disks (67) arranged at a distance from one another, said pocket linings (66) extending over the entire width of said second turret (39) to connect the turret disks (67) to one another.

7. The apparatus as claimed in claim 6, wherein the second turret (39) includes in the region of the transfer station (64) two tube folders (73, 74) which are movable to and fro in a direction tangential to said second turret for folding a portion of said second blank.

8. The apparatus as claimed in claim 7, wherein one of said tube folders (73) is equipped with a sealing device with a movable sealing jaw (86) arranged on a pivotably mounted actuating lever (87) actuable by means of an electromagnet (88).

9. The apparatus as claimed in claim 8, wherein the supporting legs (69) of the pocket linings (66) are comb-like projections (78), and said tube folders (73, 74) include a comb-like legs (75, 76) with recesses (77) and wherein the tube folders (73, 74) are also movable in a radial direction in such a way that the portions of blanks which rest on supporting legs (69) can be grasped from the outside and folded.

10. The apparatus as claimed in claim 9 wherein the tube folders (73, 74) are pivotable.

11. The apparatus as claimed in claim 1, further including means for severing said second blanks from a continuous sheet of second blank material in the region directly adjacent said second turret.

12. The apparatus as claimed in claim 11, further including suction bores (70) for grasping and maintaining said second blanks over the periphery of said second turret.

13. The apparatus as claimed in claim 12, further including a cutting roller (113) for facilitating the cutting of the second blanks, and means for synchronously driving said cutting roller, said second turret and said first turret.

14. The apparatus as claimed in claim 13, further including a manually operable piercing knife (128) cooperating with the cutting roller (113).

15. The apparatus as claimed in claim 14, further including a tautener (131) coupled to the piercing knife (128) and movable together with the piercing knife (128) on the periphery of the cutting roller (113) for pressing and tautening the continuous sheet of second blank material on the periphery of the cutting roller (113).

16. The apparatus as claimed in claim 15, further including a feeding means (123) for feeding said continuous sheet of second blank material to said cutting roller, draw rollers (155, 156) for conveying said continuous sheet to said feeding means (123), servo-motor means (157) for driving at least one of said draw rollers, the circumference of said at least one of said draw rollers corresponding to the preferred length of a second blank (24).

17. The apparatus as claimed in claim 16, wherein the feeding means (123) is provided with a dancing roller (146) movable up and down and a pendulum roller (143) movable to and fro, for producing variable sheet stocks of the foil sheet (37), in such a way that it is possible to draw the continuous sheet (37) forwards smoothly when a reel (141) is started and braked slowly.

* * * * *